United States Patent [19]

Perr

[11] 4,249,499

[45] Feb. 10, 1981

[54] TIMING MECHANISM FOR A FUEL SUPPLY SYSTEM

[75] Inventor: Julius P. Perr, Columbus, Ind.

[73] Assignee: Cummins Engine Company, Inc., Columbus, Ind.

[21] Appl. No.: 113,739

[22] Filed: Jan. 21, 1980

Related U.S. Application Data

[63] Continuation of Ser. No. 974,566, Dec. 29, 1978, which is a continuation-in-part of Ser. No. 929,340, Jul. 31, 1978, abandoned, which is a continuation of Ser. No. 755,787, Dec. 30, 1976, abandoned.

[51] Int. Cl.[3] ..... F02M 39/02; F02M 47/02; F04B 49/08

[52] U.S. Cl. ..... 123/502; 123/504; 123/500; 239/89; 417/293

[58] Field of Search ..... 123/139 AQ, 139 AP, 123/139 AR, 139 AF, 139 AK, 139 AC, 139 AT, 32 JV; 239/88, 89, 90, 95, 533.3, 533.4; 417/462, 293, 494, 499

[56] References Cited

U.S. PATENT DOCUMENTS

| | | | |
|---|---|---|---|
| 2,792,259 | 5/1957 | Shallenberg | 123/139 AK |
| 2,919,687 | 1/1960 | Friedlander | 123/139 AQ |
| 3,412,717 | 11/1968 | Carey, Jr. et al. | 123/32 JV |
| 3,831,846 | 8/1974 | Perr et al. | 239/89 |
| 3,951,117 | 4/1976 | Perr | 123/139 AP |

FOREIGN PATENT DOCUMENTS 1080311 8/1967 United Kingdom .

*Primary Examiner*—P. S. Lall

*Attorney, Agent, or Firm*—Merriam, Marshall & Bicknell

[57] ABSTRACT

This disclosure deals with a mechanism for adjusting the timing of initiation of injection by a fuel injector of an internal combustion engine. The mechanism includes a piston connected to be moved by a drive for the injector, and another piston which is connected to move the plunger of the injector. A timing fluid supply is provided for feeding a timing fluid into a timing chamber formed between the two pistons under selected operating conditions, the timing fluid forming a hydraulic link between the two pistons. The mechanism further includes pressure relief means for releasing a portion of the timing fluid after the termination of injection, the relief means comprising a pressure responsive mechanism.

19 Claims, 11 Drawing Figures

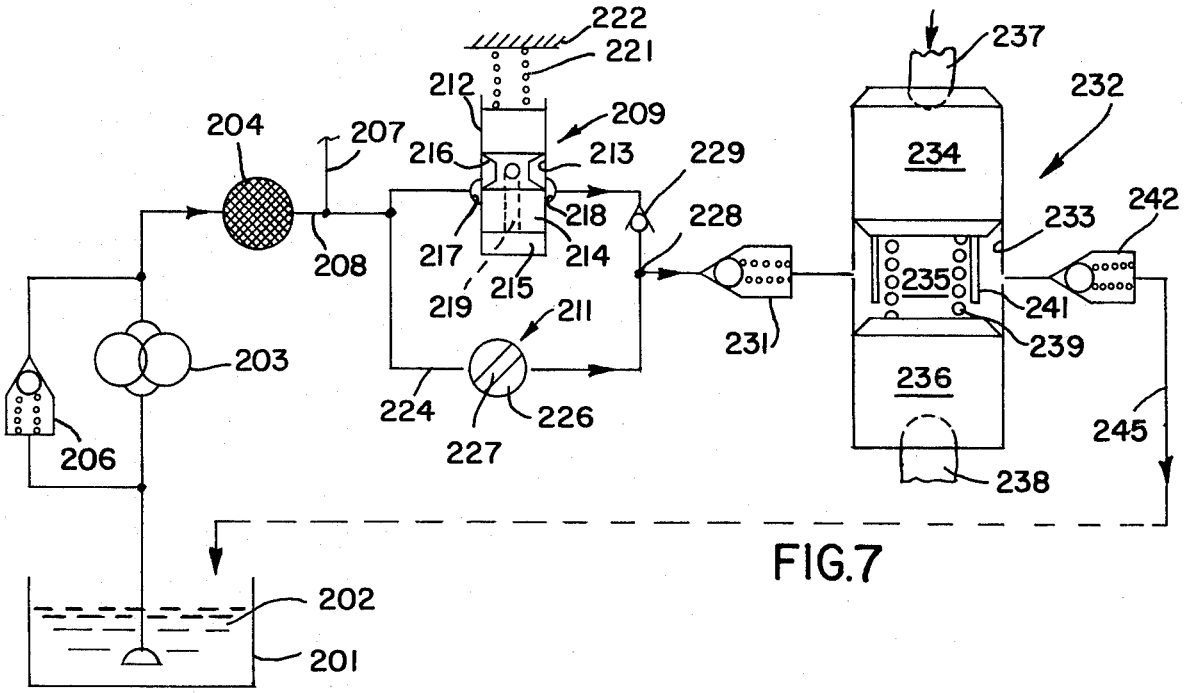
FIG.7
FIG.8
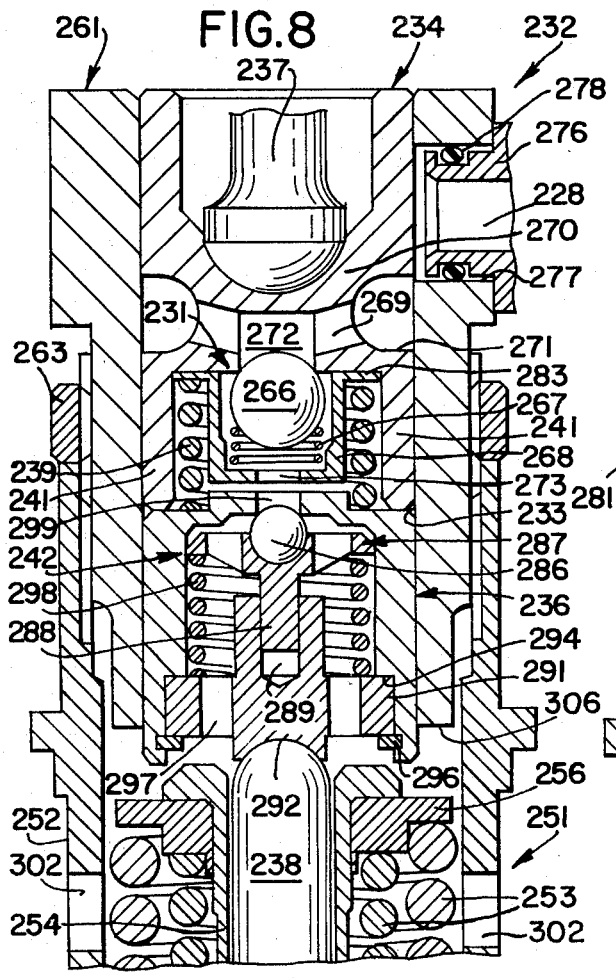
FIG.9
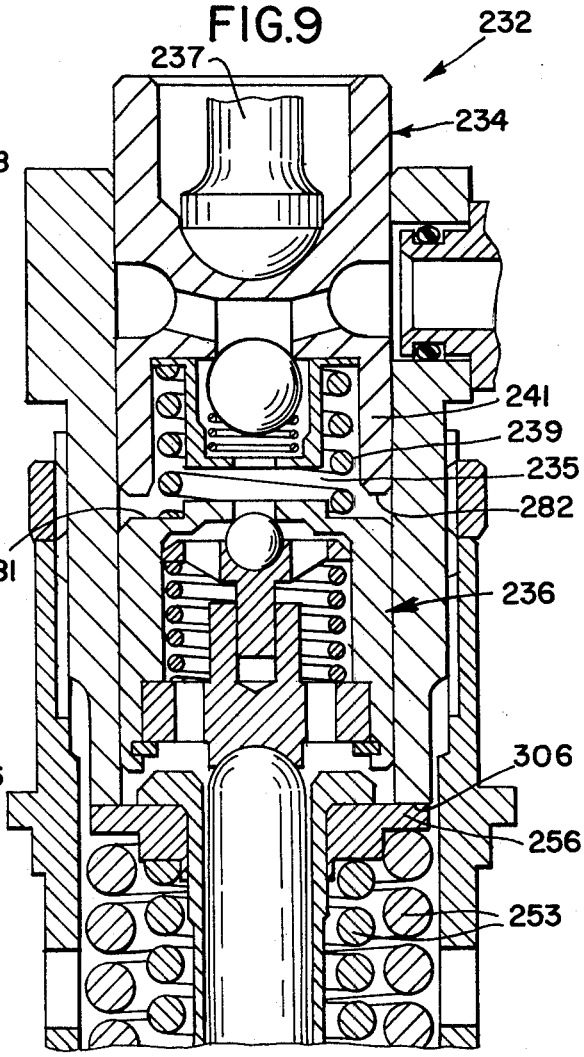

TIMING MECHANISM FOR A FUEL SUPPLY SYSTEM

This application is a continuation of pending application U.S. Ser. No. 974,566 filed Dec. 29, 1978, which is a continuation-in-part of application U.S. Ser. No. 929,340 filed July 31, 1978, now abandoned, which is a continuation of U.S. Ser. No. 755,787 filed Dec. 30, 1976, now abandoned.

BACKGROUND OF THE INVENTION

In a fuel injection type of internal combustion engine, the combustion characteristics are in part determined by the injection timing. In a typical prior art four stroke engine, fuel injection is initiated approximately between 35° of the crankshaft before top dead center (BTDC) and 5° BTDC, during the compression stroke. When the timing is advanced (closer to 35°), the combustion of the injected fuel is relatively complete because of the long length of time permitted for the combustion process. Consequently, the timing may be advanced in order to reduce the rate of fuel consumption and to reduce emission of unburned hydrocarbons. However, advanced timing produces high cylinder pressures and temperatures which result in high $NO_2$ emissions, except at low engine loads when relatively little fuel is being burned.

When the timing is retarded (closer to 5° BTDC), the $NO_2$ emissions are reduced because most combustion occurs after top dead center. However, the emissions due to unburned hydrocarbons increase, but they are not as harmful as the $NO_2$ emissions.

The timing that is normally selected is a compromise and is a value that produces low quantities of both types of emissions. There are however advantages in being able to vary the timing in response to different engine operating conditions. At idling and light loads (below approximately ¼ full load) it is advantageous to advance the timing, whereas during normal load conditions it is advantageous to retard the timing.

U.S. Pat. No. 3,951,117 dated Apr. 20, 1976, and pending U.S. patent application Ser. No. 667,264, now U.S. Pat. No. 4,134,549 disclose a fuel supply system including means for varying the timing of the initiation of injection of the fuel, and the timing may be varied through an infinite number of steps. The injectors disclosed in the above patent and application operate such that injection is terminated when a moving member moves past and opens a spill port. This method of terminating injection has the disadvantages that injection pressure is lost as soon as the spill port is opened, and that the time of termination of injection cannot easily be adjusted.

OBJECTS AND BRIEF SUMMARY OF THE INVENTION

It is a general object of the present invention to provide improved timing mechanisms for a fuel injector, which does not possess the foregoing disadvantages.

Apparatus in accordance with the invention is designed for use with an injector including a movable plunger, and with a cam drive for the plunger. The apparatus includes movable pistons connected between the cam drive and the plunger, the pistons forming a timing chamber therebetween. A volume of timing fluid is fed into the timing chamber and forms a hydraulic link between the pistons, the timing fluid volume determining the length of the link and the time of initiation of injection. The apparatus further includes pressure release means for releasing at least a portion of the timing fluid volume when the pressure in the timing chamber is above a predetermined level. In one form of the invention, the timing is adjustable through many steps, and in another form of the invention the timing is adjustable between two steps.

BRIEF DESCRIPTION OF THE DRAWINGS

The foregoing and other objects and advantages of the present invention will become apparent from the following detailed description taken in conjunction with the accompanying figures of the drawings, wherein:

FIG. 7 is a schematic diagram of a fuel supply system including another form of the invention; and FIGS. 8 to 11 are sectional views illustrating the construction and operation of the timing mechanism of the form shown in FIG. 7.

DETAILED DESCRIPTION

Figure 1:
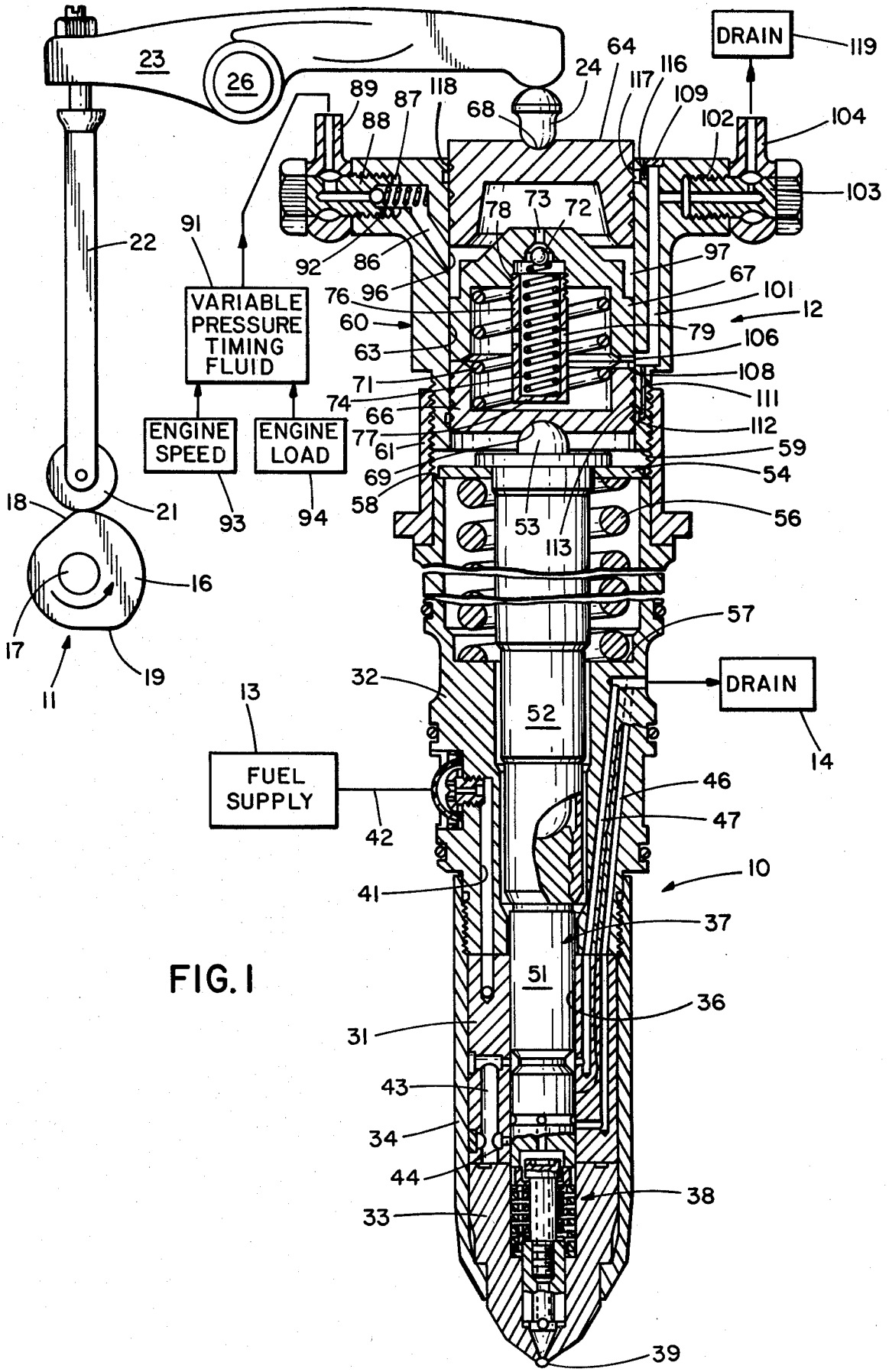
FIG. 1 is a sectional view of an injector including a variable timing mechanism in accordance with the present invention.

FIG. 1 illustrates apparatus for injecting fuel into a combustion chamber of an internal combustion engine which, aside from the present invention, may have a conventional design. The type of engine in which the apparatus may be used is, for example, a reciprocating piston, compression ignition, or diesel engine. The apparatus comprises an injector 10, a drive 11 for periodically actuating the injector to inject fuel, a timing mechanism 12 located between the drive 11 and the injector 10, a fuel supply system 13, and a drain 14.

The drive 11 includes a cam 16 secured to and rotating with a cam shaft 17 which is normally driven by the crankshaft of the engine. The cam 16 includes a positive or rising ramp 18 and a negative or declining ramp 19, which connect the inner base circle of the cam with the outer circle. A follower roller 21 rides on the cam 16, and a push tube 22 is connected between the follower roller 21 and one end of a rocker arm 23. The other end of the rocker arm 23 is connected to a link 24. The rocker arm 23 is pivotally mounted by a rocker shaft 26 on the head of the engine.

The injector 10 is of the type described and illustrated in detail in the Perr et al U.S. Pat. No. 3,831,846, issued Aug. 27, 1974. Briefly, the injector 10 comprises a barrel 31, an adapter 32 positioned on the upper end of the barrel 31, a cup or nozzle 33 positioned against the lower end of the barrel 31, and a retainer 34 which holds the foregoing injector parts in tightly assembled relation. A plunger bore 36 is formed in the adapter 32 in the barrel 31 and in the cup 33, and a plunger 37 is mounted in the bore 36. A tip valve assembly 38 is mounted in the portion of the bore formed in the cup 33, and as described in the previously mentioned patent, the assembly 38 control the flow of fuel from an injector fuel chamber, through spray holes 39, and into a combustion chamber of the engine. A fuel supply passage 41 is formed in the adapter 32 and in the barrel 31 and is connected to receive fuel from the fuel supply 13 and a supply rail 42. The fuel supply 13 is preferably a variable pressure type of the character disclosed and described in detail in the Reiners U.S. Pat. No. 3,159,152, issued Dec. 1, 1964. During operation of the engine, fuel from the supply 13 flows through the rail 42, through the supply passage 41, through a check valve arrangement described in the above U.S. Pat. No. 3,831,846, through another supply passage 43, through a metering orifice 44 and into an injector fuel chamber in which the tip valve assembly 38 is mounted. Two drain lines 46 and 47 are also formed in the barrel 31 and in the adapter 32, and connect the bore 36 with the drain 14. U.S. Pat. No. 3,831,846 provides a complete description of the operation and construction of the injector.

The plunger 37 includes a lower part 51 and a tubular upper part 52 which is secured to the upper end of the lower part 51. The injector further includes a rod 53 which extends through the tubular upper part 52 and engages the upper end of the lower part 51. A washer 54 is attached to the upper end of the upper part 52, and a return spring 56 is coiled around the upper part 52 and is mounted between the washer 54 and a ledge 57 formed on the adapter 32. As described in U.S. Pat. No. 3,831,846, the plunger 37 is movable alternately in an injection stroke and in a return stroke, and in the position of the plunger 37 illustrated in FIG. 1, the plunger 37 has just completed the movement in the injection stroke and is in the down position. Movement of the plunger 37 in the injection stroke occurs as the cam 16 rotates and the positive ramp 18 moves under the cam follower 21 and forces the rocker arm 23 to pivot in the clockwise direction as seen in FIG. 1. When the cam 16 has rotated to the point where the negative ramp 19 of the cam 16 moves under the follower 21, the rocker arm 23 is permitted to pivot in the counterclockwise direction. The return spring 56 then moves the plunger 37 upwardly to the retracted position shown in FIGS. 2 and 3. In the down position, the washer 54 engages the upper end surface 58 of the adaptor 32, and the upper end surface 58 forms a down stop for the injector. In the retracted position, the washer 54 engages the lower surface 59 of a timing housing 60, and the surface 59 forms a top stop for the injector.

The timing mechanism 12 comprises the housing 60 which is threadedly connected to a sleeve 61 which is secured to the upper end of the adaptor 32. The housing 60 has a cylindrical bore 63 formed therein, and an upper piston 64, a lower guide piston 66, and a timing piston 67 are movably mounted in the bore 63. The upper piston 64 has an inverted cup shape, and an arcuate recession 68 at the center of the upper surface of the piston 64 receives the lower end of the link 24. The lower piston 66 also has a cup shape, and an arcuate recession 69 formed at the center of the lower surface of the piston 66 receives the upper end of the rod 53. The timing piston 67 is positioned between the upper piston 64 and the lower guide piston 66 and it also has an inverted cup shape. A coiled compression timing spring 71 is positioned between the timing piston 67 and the lower piston 66, which urges the two pistons 66 and 67 apart. The timing spring 71 is located in the hollows of the cups of the two pistons 66 and 67.

The space between the two pistons 64 and 67 forms a timing chamber, and hydraulically connected with the timing chamber is a pressure relief means. In the present specific example of the invention, the pressure relief means is mounted on the timing piston 67 but it could be located elsewhere. The pressure relief means, in this example, is in the form of a spring loaded valve including a ball 72 positioned on the lower side of a passage 73 formed generally centrally of the upper surface of the timing piston 67. A coiled compression spring 74 is mounted in a spring retainer 76 and the force of the compression spring 74 urges the ball 72 against the passage 73 so as to prevent the flow of fluid through the passage 73. The spring retainer 76 is generally tubular and has a closed bottom end 77 which supports the spring 74, and the upper end of the spring retainer 76 is attached to the upper piston 67 by a threaded connection indicated at 78. Flow passages 79 are formed in the wall of the spring retainer 76. The compression spring 74, which may be referred to as the timing spring, is preloaded so that the ball 72 will normally seal the passage 73 but will move and permit fluid flow through the passage 73 only when the fluid pressure above the passage 73 is above a predetermined pressure level. The pressure of the timing fluid required to open the passage 73 is a function of the preload of the timing spring 74 and of the area of the ball 72 which is exposed to the fluid.

The housing 60 of the timing mechanism 12 further has an intake passage 86 formed therein, which extends from the bore 63 to an internally threaded opening 87. A coupling 88 is threaded into the opening 87 and secures a nipple 89 to the housing, so that a supply 91 of a timing fluid (FIG. 1) may be connected to supply timing fluid to the intake passage 86. A check valve 92 is mounted in the intake passage 86 and permits flow of the timing fluid from the nipple 89 only in the direction of the bore 63.

The timing fluid supply 91 (FIG. 1) is preferably adjustable in order to vary the timing of injection as will be explained. If desired, an engine speed responsive mechanism indicated generally by the reference number 93 may be connected to the supply 91 in order to vary the timing fluid pressure automatically in response to engine speed, and/or an engine load responsive mechanism indicated generally by the reference numeral 94, may be also connected to the supply 91 in order to vary the pressure of the timing fluid in accordance with the engine load. A system including a fluid supply system wherein the pressure responds to engine speed or load is disclosed in Perr U.S. Pat. No. 3,951,117. The timing fluid may, for example, be the engine lubricant or engine fuel, and it preferably is the lubricant.

The intake passage 86 opens into the timing chamber portion of the bore 63 at a port 96 which, in the present example, is closely adjacent the timing piston 67. The outer periphery of the timing piston 67 has an annular recess 97 formed therein so that the outer surface of the timing piston 67 cannot block or close off the port 96.

The housing 60 further includes a passage 101 which leads from the bore 63 to an internally threaded opening 102. Another coupling 103 is threaded into the opening 102 and secures another nipple 104 to the housing 60. The passage 101, where it opens into the bore 63, forms a port 106, and the port 106 is located adjacent the upper end of the sidewall of the lower piston 66. The upper edge of the lower piston 66 and the lower edge of the timing piston 67 have recesses or cut-outs indicated at 108 so that these pistons cannot cover and close off the port 106. The vertical portion of the passage 101 is formed by drilling a passage from the upper end of the housing 60, and after the passage has been drilled a plug 109 is secured in the outer end of the drilled passage in order to seal it.

Leakage passages may also be formed in the housing 60 and lead to the passage 101. A leakage passage 111 is formed from the lower end of the drain passage 101 to an annular groove 112 which is formed in the surface of the bore 63 adjacent the lower end of the lower piston 66. The outer periphery of the lower piston 66 has a series of annular grooves 113 formed therein, which function to lubricate the adjoining surfaces, and any timing fluid which leaks downwardly between the adjoining surfaces of the piston 66 and the housing 60 is collected in the annular groove 112 and carried to the line 101 by the leakage passage 111.

A similar leakage arrangement is provided for the upper piston 64. Another leakage passage 116 is formed in the housing 60 leading from the passage 101 to an annular groove 117 in the surface of the bore 63 adjacent the upper end of the bore. Annular grooves 118 are formed in the outer periphery of the piston 64, and any leakage will be collected in the groove 117 and returned to the passage 101. The passage 101 is connected by the nipple 104 to a drain 119, and the drain 119 and the passage 101 are preferably at atmospheric pressure. The supply 91 may receive timing fluid from the drain 119.

Figure 3:
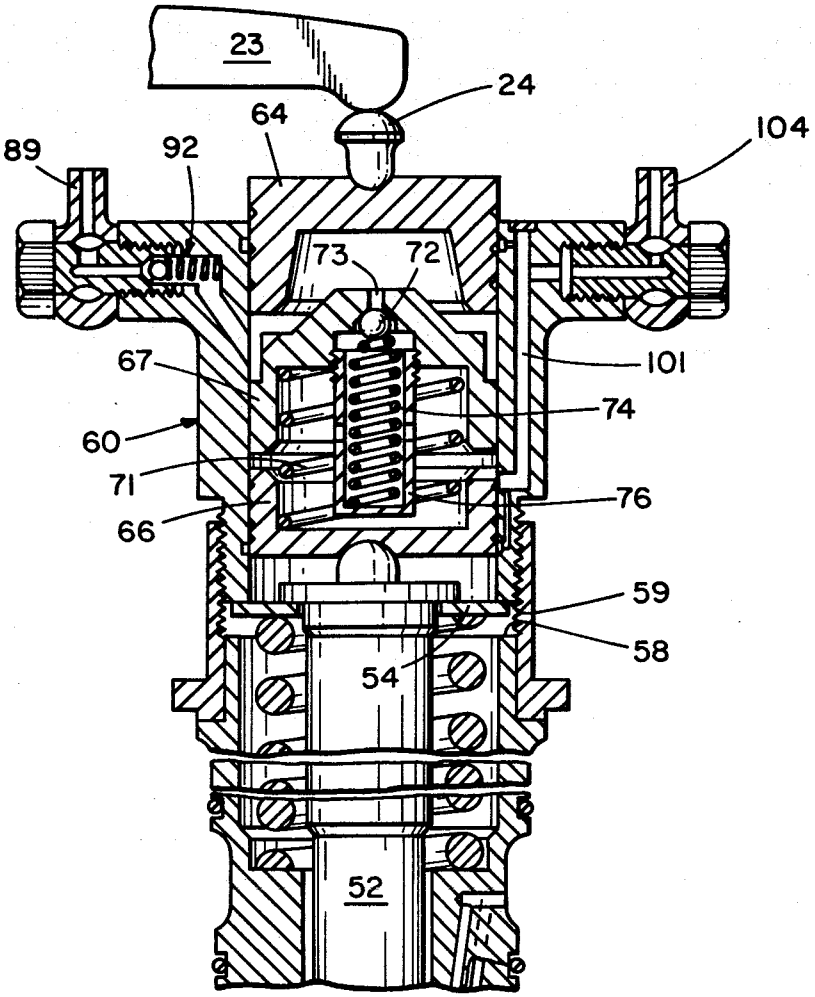
FIGS. 2 and 3 are fragmentary views of a portion of the injector shown in FIG. 1, and illustrating different positions of the parts of the timing mechanism.
Figure 2:
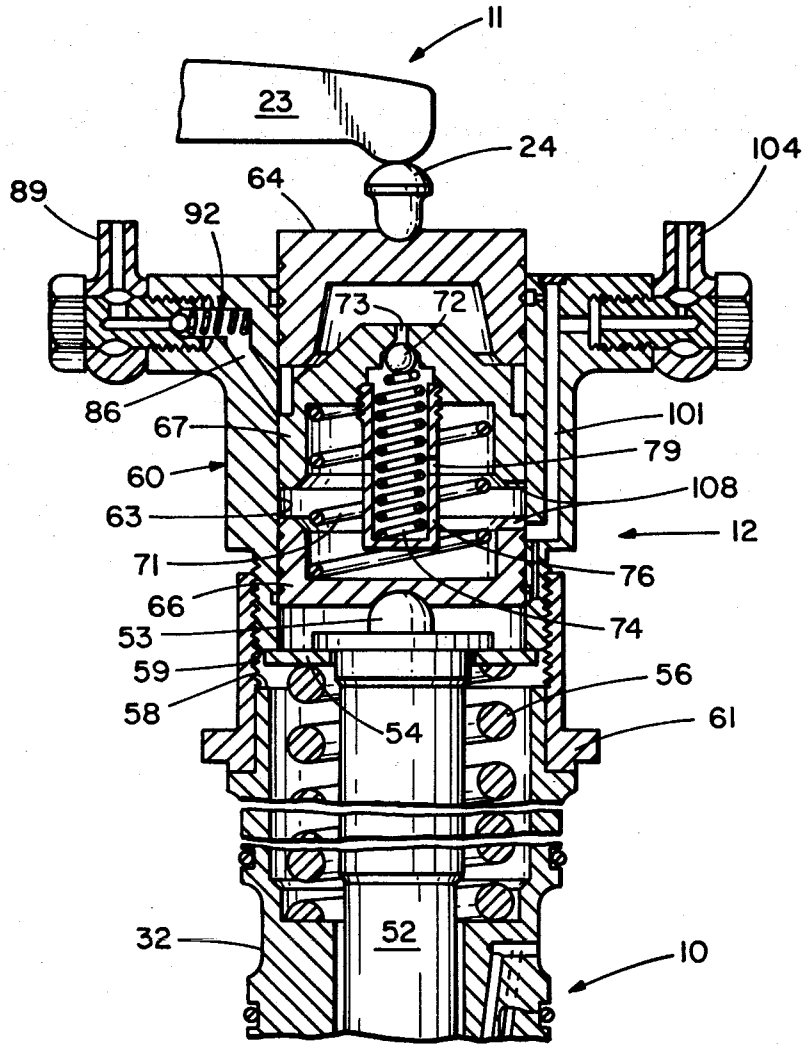

The position of the parts shown in FIG. 1 illustrates the condition at the end of the injection stroke when the plunger 37 is in the down position; FIG. 2 illustrates the positions of the parts when the plunger 37 has just been returned to the retracted position and the metering period of the timing fluid is about to start; and FIG. 3 illustrates the positions of the parts at the end of the metering of the timing fluid and just before the start of the injection stroke. During the retraction stroke, the return spring 56 of the injector 10 pushes the washer 54 upwardly, carrying the plunger 37 with it, until the upper surface of the washer 54 engages the top stop 59. As the washer 54 moves upwardly, the rod 53 moves the lower piston 66 upwardly and the timing spring 71 pushes the timing piston 67 upwardly into engagement with the upper piston 64. The timing spring 71 is strong enough to move the pistons 67 and 64 upwardly and the injector drive train to the positions shown in FIG. 2, and it should be noted that the pistons 66 and 67 separate and that the upper end of the timing piston 67 engages the lower end of the upper piston 64. Timing fluid from the supply 91 flows through the nipple 89, the check valve 92, the recess 97 and into the timing chamber formed between the upper piston 64 and the timing piston 67. As the timing fluid enters the timing chamber, it forms a timing volume and the pressure is high enough to force the timing piston 67 downwardly against the force of the timing spring 71. The pressure of the timing fluid is however below that needed to open the relief valve formed by the ball 72 and the passage 73. As the timing fluid is metered into the timing chamber, the timing piston 67 moves downwardly as shown in FIG. 3 until the force of the timing fluid balances the force of the timing spring 71. The amount of the force of the timing fluid on the timing piston 67 is a function of the pressure of the timing fluid and of the area of the upper surface of the timing piston 67, and the pressure of the timing fluid and the force of the timing spring 71 are selected so that the piston 67 is displaced downwardly by an amount necessary to produce the desired time of initiation of injection. During the flow of the timing fluid into the timing chamber, fluid also fills the space between the timing piston 67 and the lower piston 66, and as the timing piston 67 moves downwardly, some of the fluid from the space between the two pistons 66 and 67 is squeezed out of the bore 63 through the port 106 and the return passage 101.

During the flow of the timing fluid into the timing chamber, fuel is also being metered into the fuel chamber formed in the injector 10 around the tip valve assembly 38, as described in detail in the previously mentioned U.S. Pat. No. 3,831,846.

At the end of the flow of the timing fluid, the timing piston 67 is displaced downwardly as shwon in FIG. 3 and the check valve 92 closes. At the start of the injection stroke, the cam 16 is at the position where the positive ramp 18 moves under the cam follower 21 and forces the push tube 22 upwardly and the link 24 downwardly. The downward pressure on the link 24 and the upper piston 64 causes pressure to be exerted on the timing fluid volume in the timing chamber which closes the check valve 92 and traps the timing fluid volume in the timing chamber. The two pistons 64 and 67 are then moved downwardly with the timing volume in the timing chamber between them, the timing volume forming a hydraulic link between the pistons 64 and 67. The length of the hydraulic link is determined by the volume of the timing fluid which in turn is a function of the pressure of the timing fluid from the supply 91. Some of the timing fluid in the space between the lower piston 66 and the timing piston 67 flows out of this space through the recesses 108 and out of the passage 101 until the lower end of the timing piston 67 engages the upper end of the lower piston 66, as shown in FIG. 1. Thereafter, the three pistons 64, 66 and 67 all move downwardly together. The movement of the three pistons forces the rod 53 and the plunger 37 downwardly and injection of fuel into the combustion chamber of the engine then occurs. Injection continues as the three pistons and the plunger move downwardly, until the tip valve assembly 38 operates to terminate injection as described in the previously mentioned U.S. Pat. No. 3,831,846. After the tip valve assembly has terminated injection, the three pistons continue their downward movement for a short distance or overrun until the washer 54 engages the bottom stop 58 as shown in FIG. 1. At this point, the washer 54, the rod 53, the lower piston 66 and the timing piston 67 can no longer move downwardly and the cam follower 21 is almost at the top of the positive ramp 18. The upper piston 64 continues to move downwardly until the roller 21 is at the top of the slope 18, causing high timing fluid pressure to exist in the timing chamber. This high pressure is sufficient to overcome the preload of the spring 74, and the ball 72 is moved off of its seat and opens the orifice 73, as shown in FIG. 1. A portion of the timing volume in the timing chamber then flows through the orifice 73, out of the passages 79, through the recesses 108 and the passage 101, until the cam follower reaches the top of the slope 18. Even though fluid stops flowing out of the timing chamber, pressure at the level of the preload of the spring 74 continues to exist in the timing chamber, which maintains the pressure on the plunger 37 and the tip valve assembly, until the cam 16 has rotated to the point where the follower 21 moves down the negative slope 19. When the pistons 64 and 67 are separated by the spring 71, some of the timing fluid is drawn into the space between the pistons 64 and 67, from the passage 101. The foregoing cycle of events is then repeated.

It will be apparent from the foregoing that the plunger 37 starts to move downwardly when the lower piston 66 is engaged by the timing piston 67. This occurrence is dependent upon the volume of the timing fluid in the timing chamber, which determines the length of the hydraulic link between the pistons 64 and 67. It will be apparent therefore that the time of initiation of injection is a function of the quantity of the timing fluid in the timing chamber, which is controlled by the pressure of the timing fluid from the supply 91. The pressure range and the force of the spring 71 are selected to produce the desired time of initiation of injection. This time may of course be easily adjusted by varying the pressure of the timing fluid from the supply 91, and means may be provided for varying the pressure automatically in response to engine speed and/or to engine load. U.S. Pat. No. 3,351,288 describes appropriate mechanisms for producing engine speed and engine load signals.

The time of termination of injection is determined by the design of the tip valve assembly and the other injector parts as described in U.S. Pat. No. 3,831,846. Pressure is maintained on the plunger 37 after termination of injection, this pressure being determined by the characteristics of the relief spring 74 and the size of the passage 73, and these factors can of course be designed to produce the desired pressure level.

Figure 4:
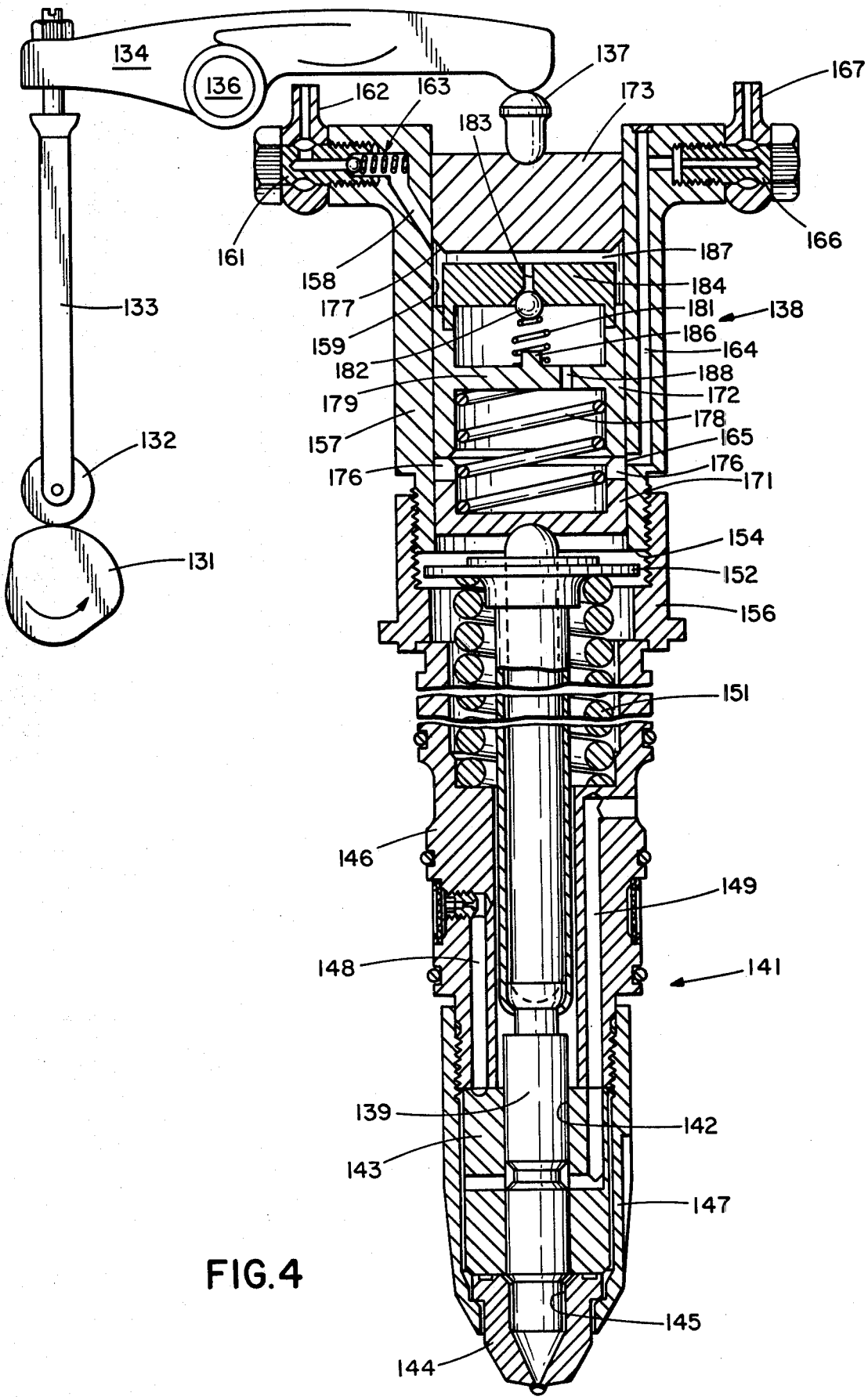
FIG. 4 is a view similar to FIG. 1 but illustrating a different form of the invention.
Figure 6:
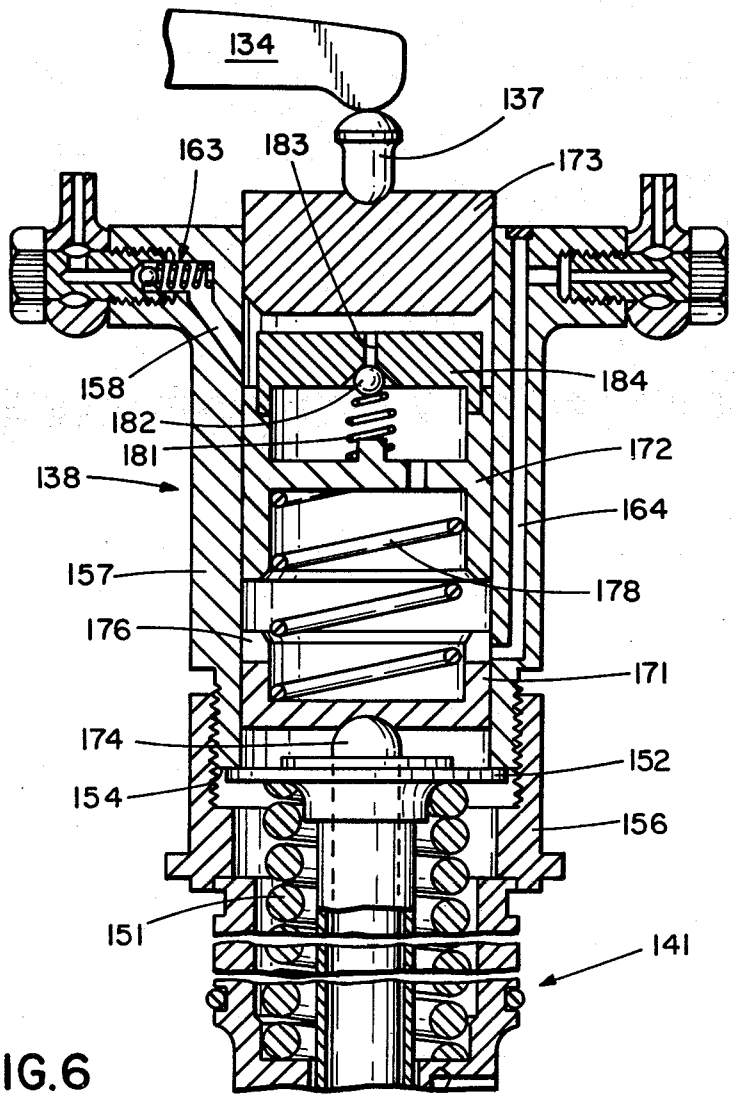
FIGS. 5 and 6 are views similar to FIGS. 2 and 3 but illustrating different positions of some of the parts of the injector shown in FIG. 4.
Figure 5:
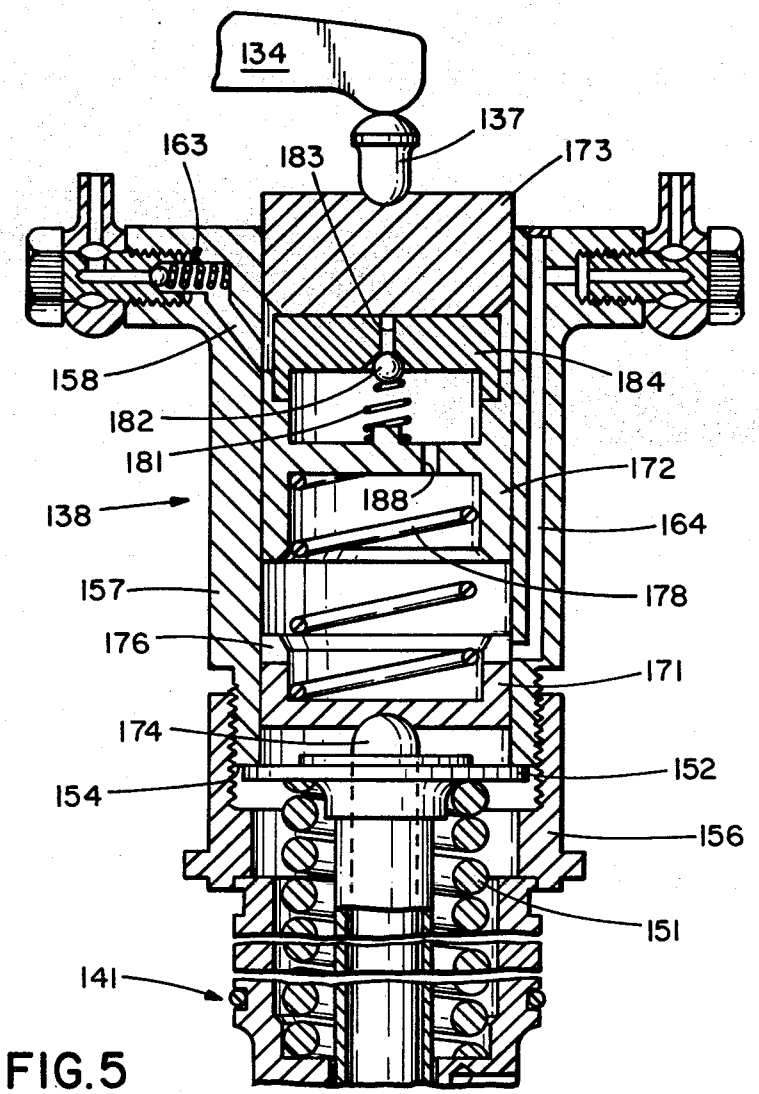

FIGS. 4, 5 and 6 illustrate another form of timing mechanism and another form of injector. It should be understood however that any of the timing mechanisms illustrated herein may be used with all of the injector forms. The structure shown in FIGS. 4 through 5, includes a drive including a cam 131, a follower 132, a push tube 133, a rocker arm 134 movable on a rocker shaft 136, and a link 137. The timing mechanism 138 is again mounted between the link 137 and the plunger 139 of an injector 141. The injector 141 is of the character illustrated and described in detail in the Perr U.S. Pat. No. 3,351,288, issued Nov. 7, 1967. Briefly, the injector 141 includes the plunger 139 which is movable in a plunger bore 142 formed in a barrel 143, a cup 144 and an adaptor 146. A retainer 147 holds the parts 143, 144 and 146 together. A fuel supply passage 148 is formed in the adaptor 146 and in the barrel 143 and supplies fuel under a variable pressure to a fuel receiving chamber 145 formed in the lower end of the plunger bore. A return passage 149 is also formed in the injector parts for returning fuel to a reservoir or drain. A return spring 151 is connected between the adaptor 146 and a washer 152 fastened to the upper end of the plunger 139, and the return spring 151 moves the plunger 139 upwardly in the retraction stroke after an injection stroke.

The timing mechanism 138 is attached to the injector by a sleeve 156 that is secured to the upper end of the adaptor 146 and is theadedly connected to the lower end of a housing 157 of the timing mechanism 138. The timing mechanism housing 157 has a timing fluid supply passage 158 formed therein which extends from a bore 159 to a coupling 161 and a nipple 162. A check valve 163 is again mounted in the supply passage 159 and permits the flow of timing fluid from the nipple 162 only in the direction of the bore 159. Instead of a spring loaded valve as shown, a gravity type check valve may be used in order to avoid the spring which may interfere with the metering of the fluid. The housing 157 further has a passage 164 formed therein which extends from a port 165 to a coupling 166 and a nipple 167. The nipple 167 leads to a drain similar to the drain 119, and the nipple 162 is connectable to a variable pressure timing fluid supply similar to the supply 91. The timing mechanism 138 further includes a lower piston 171, a timing piston 172 and an upper piston 173. The lower piston 171 engages the upper end of a rod 174 which extends between the lower piston 171 and the plunger 139. The upper piston 173 engages the lower end of the link 137. The timing piston 172 is mounted between the lower piston 171 and the upper piston 173, and the three pistons 171, 172 and 173 are movably mounted in the bore 159 of the housing 157. The lower piston 171 is generally cup shaped and has recesses or cut-outs 176 formed therein which ensure that the side wall of the piston 171 does not cover and block the port 165. The upper piston 173 has a generally cylindrical solid shape and has a recess 177 which ensures that the piston 173 does not cover and block the opening of the supply passage 158.

The timing piston 172 is the shape of the letter H in cross section, and the lower end of the cylindrical vertical wall of the piston 172 engages or seats on the upper end of the vertical wall of the piston 171 during the injection stroke. A timing spring 178 is positioned between the lower piston 171 and the timing piston 172, the upper end of the timing spring 178 engaging the cross member 179 of the timing piston 172. The timing piston 172 also includes a pressure relief means in the form of a spring loaded ball valve including a spring 181 and a ball 182 positioned at the bottom of an orifice 183 formed centrally of a top part 184 which forms part of the timing piston 172. The part 184 extends across the upper end of the vertical wall of the timing piston 172 and is secured thereto. The spring 181 is positioned against the ball 182 and around a central projection 186 which holds the spring 181 in place. The ball 182 normally seals the orifice 183 but timing fluid is able to flow from a timing chamber 187 formed between the timing piston 172 and the upper piston 173, when the pressure in the timing chamber 187 exceeds a predetermined level. Timing fluid entering the orifice 183 flows into the space around the spring 181 and downwardly through a passage 188 formed in the cross member of the piston 172, and out of the housing bore 159 through the port 165 and the return passage 164.

FIG. 4 illustrates the positions of the parts at the end of an injection stroke when the plunger 139 is in the down position, FIG. 5 illustrates the positions of the parts at the end of the retraction stroke when the parts are in the retracted position, and FIG. 6 illustrates the positions of the parts during the metering of the timing fluid.

Considering the operation of the mechanism shown in FIGS. 4 through 6, assume that the positions of the parts are as shown in FIG. 5 where the plunger is in the retracted position and the washer 152 engages the top stop 154. The timing spring 178 has moved the timing piston 172 and the upper piston 173 to the upwardmost positions where the link 137 is pressed against the rocker arm 134. Timing fluid from the supply then passes through the check valve 163, as shown in FIG. 6, and enters the chamber 187, thereby moving the timing piston 172 downwardly. The timing fluid enters the timing chamber 187 until the force of the timing fluid in the chamber 187 balances the force of the timing spring 178. Again, the amount of the fluid force is a function of the pressure of the timing fluid in the chamber 187 and of the area of the upper end of the timing piston 172.

At the beginning of the injection stroke, the cam 131 has turned to the point where the positive ramp of the cam 131 moves under the follower 132, the rocker arm 134 is pivoted in the clockwise direction, and the upper piston 173 is forced downwardly. This downward movement of the piston 173 traps the timing fluid in the timing chamber 187 because the pressure closes the check valve 163. Of course, the pressure is not high enough to open the pressure relief valve formed by the ball 182 and the orifice 183. The upper piston 173, the timing fluid volume in the chamber 187, which forms a hydraulic link, and the timing piston 172 move downwardly together and compress the spring 178 as some of the fluid in the chamber around the timing spring 178 flows out of this chamber through the recess 176 and the return passage 164, until the lower end of the timing piston 172 engages the upper end of the lower piston 171. At this point, the three pistons move downwardly together and force the rod 174 and the plunger 139 downwardly to effect injection of fuel. Injection continues until the plunger engages the seat formed in the cup 144 which stops the downward movement of the plunger 139. This also of course stops the downward movement of the lower piston 171 and the timing piston 172, and pressure builds up in the timing chamber 187 until the fluid pressure overcomes the force of the spring 181 on the ball 182. Some of the timing fluid then flows from the chamber 187, through the orifice 183, the passage 188 and out of the bore 159 through the recess 176 and the passage 164. The parts remain in this position and pressure is maintained on the plunger 139 until the cam 131 rotates to the point where the negative slope of the cam moves under the follower 132 and enables the return spring 151 to move the pistons upwardly, and start a new cycle of operation.

The timing mechanisms shown in FIGS. 1 to 6 are preferred in a situation where a variation in the timing is desired through a large number of steps. The arrangement shown in FIGS. 7 to 11 is preferred where only two settings of the timing are necessary or desired.

FIG. 7 shows a complete control system wherein a lubricant 202 is drawn from a sump or reservoir 201 by a lubricant pump 203 and pumped through a filter 204. A pressure regulator 206 holds the pump output pressure at a relatively high fixed value. A lube rifle or rail 207 is connected to the filter outlet 208 and conveys the lubricant to the various operating parts of the engine.

The timing mechanism according to this embodiment of the invention is also connected to the filter outlet 208. The mechanism includes a branch pressure adjusting arrangement comprising a low pressure regulator 209 in one branch and a two position valve 211 in the other branch. The regulator 209 comprises a piston 214 that is movable in a bore 213 formed in a valve housing 212. The piston 214 has an annular groove 216 formed in it which is in flow communication with inlet and outlet ports 217 and 218 of the housing 212, the two ports 217 and 218 opening into the bore 213. The inlet port 217 receives lubricant from the filter outlet 208 and the outlet port 218 is connected to the timing mechanism outlet 228 through a check valve 229. The bore 213 is closed at one end 215 and a passage 219 of the piston 214 passes the lubricant from the groove 216 to the closed end 215. A spring 221 connected between the piston 214 and a housing part 222 urges the piston toward the closed end 215, but the lubricant pressure in the closed end 215 counterbalances the spring force. When the lubricant pressure in the groove 216 and in the closed end 215 increases, the pressure moves the piston 214 upwardly and the lower edge of the groove 216 increasingly closes off the inlet port 217, thus reducing the pressure in the groove 216 and in the outlet port 218. When the pressure in the groove 216, and therefore in the end 215, is reduced, the spring 221 moves the piston 214 downwardly slightly, which increases the flow area of the port 217 and thus increases the pressure in the groove 216. The regulator 209 thus holds the pressure at the outlet port 218 at a substantially constant value which is determined by the spring 221 force and the area dimensions of the parts. This value is chosen to be substantially lower than the pump 203 pressure at the filter outlet 208.

The valve 211 comprises a member 226 having a flow passage 227. The valve member 226 is rotatable to an open position where the passage 227 permits lubricant flow through the branch 224, and to a closed position (shown in FIG. 7) where it blocks fluid flow.

When the valve 211 is in the open position, the relatively high full pump pressure appears at the outlet 228, and when it is in the closed position the relatively low regulated pressure from the regulator 209 appears at the outlet 228. The check valve 229 prevents the high pressure, when the valve 211 is open, from flowing into the port 218. While a specific arrangement is disclosed for selectively providing two pressure levels at the outlet 228, it should be understood that other mechanisms could be used for this purpose.

The system further includes a two position or two step timing mechanism 232 that is connected in the drive train of an injector. A link 237 is connected to be driven by a cam and follower arrangement such as that shown in FIG. 1, for example, and a second link 238 is connected to drive the plunger of an injector (not shown in FIG. 7). The mechanism 232 includes upper and lower pistons 234 and 236 which are movable in a bore 233 and which respectively engage the upper and lower links 237 and 238. The two pistons are separated and form a timing chamber 235 between them. A compression spring 239 in the chamber 235 urges the two pistons apart, and a pair of arms 241 attached to one of the two pistons extends into the chamber 235. A spring loaded inlet valve 231 is connected between the outlet 228 and the chamber 235, and a load cell or pressure release valve 242 connects the chamber 235 with a lubricant return line 245 that carries the lubricant back to the reservoir 201. Both of the valves 231 and 242 are spring loaded ball type valves, the valve 231 permitting lube flow into the chamber 235 only when the pressure differential across it is above a certain value, and the valve 242 spilling lubricant from the chamber 235 to the return line when the chamber 235 pressure is above a substantially higher value. The return line 245 is at substantially atmospheric pressure.

Briefly, during engine operation the pump 203 supplies lubricant under pressure to the outlet 208. When the valve 211 is closed as shown in FIG. 7, which is one mode of operation, the regulated low pressure from the regulator 209 appears at the outlet 228, but this low pressure is not high enough to open the inlet valve 231. Consequently, the two pistons 234 and 236 are relatively close together and the arms 241 engage the piston 236 and form a mechanical link between the pistons 234 and 236 when the line 237 and the pistons 234 are driven downwardly. The release valve 242 does not open in this mode.

When the valve 211 is turned to the full open position, in the second mode of operation, the full pump 203 pressure appears at the outlet 228. This relatively high pressure is sufficient to open the valve 231 and the lubricant flows into the timing chamber 235. The pressure of this timing fluid in the timing chamber 235, and the force of this spring 239 are sufficient to separate the two pistons 234 and 236. When the link 237 is subsequently driven in the injection stroke, the increased pressure on the timing fluid due to the downward movement of the piston 234 causes the valve 231 to close, but this increased pressure is not enough to open the release valve 242. At the end of the injection stroke, the link 238 and the piston 236 stop moving but the other piston 234 overruns or continues to move a short distance. During the overrun, the chamber 235 pressure reaches a very high value which is enough to open the release valve 242 and to spill the lubricant from the chamber 235.

In the second mode of operation, the timing of injection is advanced because the separation of the pistons 234 and 236 causes the injection to start relatively early in the cycle. The lubricant trapped in the timing chamber 235 forms a hydraulic link between the two pistons and moves with the pistons during the injection stroke, until it is spilled at the end of the injection stroke when the valve 242 opens. In the first mode of operation, the timing is retarded because these pistons are relatively close together.

FIGS. 8 to 11 illustrate the construction of the timing mechanism 232 in greater detail. This specific example shows the mechanism attached to the upper end of an injector 251 (FIG. 8) as shown in FIG. 1, but the mechanism could also be connected at a different point in the injector drive train. The injector 251 includes a sleeve 252 fastened to the upper end of the injector body (not shown), the sleeve 252 being internally threaded at its upper end. The link 238 is coaxial within the sleeve 252 and is urged upwardly by a pair of coaxial return springs 253. A sleeve 254 is mounted between the link 238 and the springs 253, and a collar 256 connects the upper ends of the springs 253 with the sleeve 254. Thus, the return springs 253 urge the collar 256, the sleeve 254, and the link 238 upwardly relative to the injector body and sleeve 252.

The mechanism 232 includes a generally tubular housing 261 that is screwed into the upper end of the sleeve 252, and a lock nut 263 secures the parts together. The two pistons 234 and 236 are positioned in the bore 233 of the housing and engage the two links 237 and 238. The line 228 is formed by a tube 276 that is fastened in a hole 277 formed in the sleeve 261, the connection being sealed by an O-ring 278. The inlet valve 231 is mounted inside the housing 261 as will be described.

The upper piston 234 has the general shape of the letter H in cross section and an annular groove 271 is formed in its outer surface around the cross bar 270 of the H. Radial and vertical passages 269 and 272 connect the groove 271 with the chamber formed by the lower opening of the H. The groove 271 is always in flow communication with the hole 277 during the piston movement.

The lower wall of the H forms the arms 241 of the upper piston, and the inlet valve 231 is mounted in the opening below the cross bar 270 of the H. The valve 231 comprises a ball 266 adjacent the lower end of the passage 272, and an inlet spring 267 urges the ball 266 upwardly against the margin of the lower end of the passage 272. A spring cage 268 encloses the ball 266 and the spring 267 and a flange 283 at the upper end of the cage engages the underside of the cross bar 270 of the H. The spring 239, which may be referred to as the pumping spring, is mounted between the upper surface of the lower piston 236 and the flange 238 of the cage 268, and it holds the cage against the cross bar 270. A hole 273 in the lower wall of the cage 268 permits lubricant flow through the cage.

The lower piston 236 has the shape of an inverted U in cross section, and the load cell or pressure release valve 242 is mounted within its enclosure. The valve 242 comprises a ball 286 supported in a recess formed in the upper surface of a ball support 287. A centrally located hole 299 is formed in the upper cross wall of the piston 236, and the ball 286 normally engages the lower margin of the hole 299. A spider or socket 291 is positioned in an internal groove 294 formed at the lower end of the piston 236 and is held in place by a snap ring 296. The lower side of the spider 291 has a socket 292 formed in it which receives the link 238, and it includes an axially located hole 289 which receives a downwardly extending support leg 288 of the ball support 287. The leg 288 is able to move up and down in the hole 289 during operation. A load cell spring 298 is positioned between the spider 291 and the ball support 287 and urges the ball 286 upwardly into engagement with the lower end of the passage 299. A plurality of angularly spaced holes 297 are formed in the spider 291 for lubricant flow through the valve 242, and such lubricant flow passes out of the injector through holes 302 formed in the wall of the sleeve 252, the holes 302 being connected to the return line 245.

As mentioned previously, the timing mechanism 232 is illustrated in a specific example where it is attached to the upper end of an injector, and it is in the drive train between the links 237 and 238 which correspond to the links 137 and 174 shown in FIG. 4. The injector 251 shown in FIGS. 8 to 11 may have the construction illustrated in FIG. 4. The cam follower associated with the injector is on the outer circle of the cam. This position corresponds to the position of the parts illustrated in FIG. 4. FIG. 9 illustrates the positions of the parts at the end of the return stroke of the plunger and during the time that the cam follower is on the dwell portion, or the inner circle, of the cam. In this position of the parts, the collar 256 has been moved upwardly by the return springs 253 and it engages the lower end surface 306 of the housing 261, this lower end surface 306 thus forming an upper or top stop. The spring 239 between the two pistons 234 and 236 moves the upper piston 234 upwardly to its maximum extent and holds the cam follower tightly on the inner circle of the cam and keeps slack out of the drive train.

Assuming that the engine is to be operated in its retarded timing mode, which is the condition that is normally desired when operating under normal and high loads, the valve 211 is turned to the position illustrated in FIG. 7 where it closes the branch line 224. The timing fluid pressure appearing at the outlet 228 is therefore the low pressure regulated by the low pressure regulator 209 and this pressure is chosen to be sufficiently low that it does not open the inlet valve 231. The low pressure at the outlet 228 appears in the passages 269 and 272 and exerts a downward force on the exposed upper surface of the ball 266. Further, the force of the spring 239 which moves the two pistons 234 and 236 apart to the positions illustrated in FIG. 9 creates a suction or partial vacuum in the timing chamber 235 between the two pistons 234 and 236, but the combination of the low lubricant pressure in the passage 272 and the suction on the lower side of the ball 266 is not sufficient to overcome the force of the inlet spring 267. Therefore, the ball 266 is held against its seat on the margin of the passage 272 and prevents the lubricant from flowing through the passage 272 and into the timing chamber 235. As the injection drive cam rotates and subsequently moves the links 237 and the upper piston 234 downwardly in the next injection stroke, the upper piston 234 simply moves downwardly until the lower end surfaces 282 of the arms 241 engage the upper surface 281 of the lower piston 236, and the parts then move downwardly together, the two pistons 234 and 236 having a metal-to-metal coupling between them. Since this timing chamber 235 is only partially filled with the timing lubricant, there is no pressure on the timing lubricant and the release valve does not open.

Figure 11:
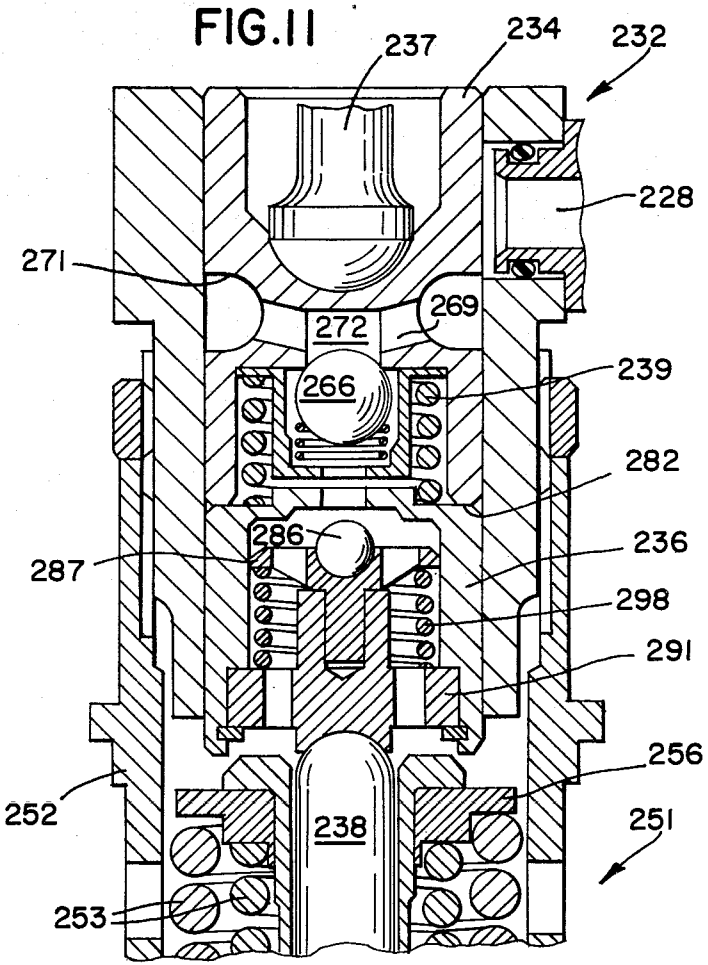
Figure 10:
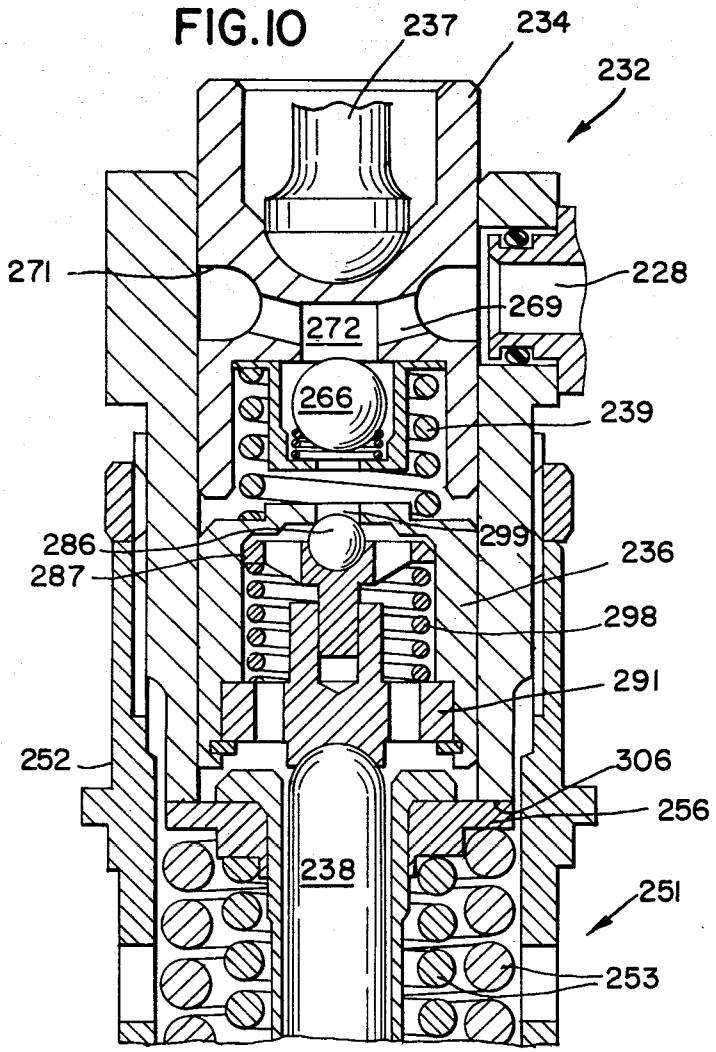

When the engine is to be operated in its advanced timing mode of operation, which is the mode desired for idling and light load operation, the valve 211 is turned to open the line 224. Consequently, the relatively high full pressure of the pump 203 appears in the outlet line 228 and in the passages 269 and 272 of the upper piston 234. When the two pistons 234 and 236 are moved upwardly to the retracted position shown in FIGS. 9 and 10, the combined high pressure of the timing fluid in the passage 272 and the suction formed in the timing chamber 235 due to the separation of the two pistons 234 and 236 caused by the spring 239, moves the ball 266 downwardly off of its seat (see FIG. 10) and the lubricant flows through the passage 272 and into the timing chamber 235. The passages are sufficiently large and the pressure is sufficiently high that the timing chamber 235 quickly completely fills with the timing fluid regardless of the speed of the engine. At the beginning of the next subsequent injection stroke, the link 237 forces the upper piston 234 downwardly and the increased pressure on the lubricant in the timing chamber 235 immediately causes the ball 266 to move into the lower end of the passage 272 and close it. The ball 266 operates as a one-way check valve and it traps the lubricant, or timing fluid, in the timing chamber 235. The trapped timing fluid thus forms a relatively incompressible hydraulic link between the two pistons 234 and 236, and the two pistons with the link between them move downwardly as a unit and force the plunger downwardly to inject fuel. At the end of the injection stroke, the lower end of the plunger engages the cup, as shown in FIG. 4, and consequently the downward movement of the plunger stops. The spider 291 and the lower piston 236 also, of course, stop at this point but the cam follower has not reached the outer circle of the cam. It is still moving upwardly near the upper end of the positive ramp of the cam. Consequently, the link 237 and the upper piston 234 continue to move downwardly a short distance in an overrun, thereby creating extremely high pressure on the lubricant in the timing chamber 235. When a predetermined release pressure is reached, the pressure being determined by the strength of the compression spring 298 and the areas of the pressure release valve parts, the ball 286 is moved downwardly off of its seat, as shown in FIG. 11, and the lubricant spills from the timing chamber 235, through the passage 299, through the passages formed in the ball guide 287 and in the spider 291, and out of the injector through the outlet passages 302. This pressure is maintained on the timing fluid or lubricant, the lower piston 236, and on the injector plunger until the surfaces 282 engage the lower piston as shown in FIG. 11, and then the ball 286 is returned to its valve seat. The timing chamber 235 is filled or charged and is emptied in each injection cycle of the injector. This is considered advantageous because it permits the timing of injection to be changed extremely rapidly, almost from one engine cycle to the next.

It will be apparent from the foregoing that novel and useful timing mechanisms for an engine have been provided. In one form of the mechanism, the timing is variable through an infinite number of steps and the changes in timing may be made substantially linearly with changes in the lubricant pressure. The pressure may be made variable in response to an engine parameter such as engine load and/or speed to obtain the optimum timing for different engine operating characteristics. The timing may be rapidly varied because the timing fluid volume is reduced and replenished in each engine cycle, and consequently the timing may be changed from one cycle to the next. The pressure relief valve forms a load cell which maintains pressure on the injector of the plunger after termination of injection, and this pressure is independent of engine speed. Further advantages are that the mechanisms may be used with various existing fuel injectors and the mechanisms may be adjusted to make injection occur at any part of the positive slope of the cam.

With regard to the form of the timing mechanism illustrated in FIGS. 7 through 11, a relatively uncomplicated timing control circuit may be employed since it relies on only two pressure conditions, either a relatively low pressure or a relatively high pressure. These two pressure ranges or levels are easy to maintain in spite of variations in the engine's parts due to wear or manufacturing tolerances.

As a specific example of the pressure levels, the outlet pressure of the lubricant pump of a new engine is around 100 psi, and when the valve 211 is closed the regulator 209 holds the pressure at the outlet 228 at approximately 5 psi. The valve 231 is designed to open at above approximately 10 psi, and when the valve 211 is open the outlet 228 pressure is easily high enough to fill the timing chamber. The release valve 242 is designed to open when the timing chamber pressure is many thousands of pounds. The design of the valves 209, 231 and 242 to achieve these operating pressures is well known to those skilled in the art. Because of the wide separation of the different operating pressures, the timing mechanism will work well in spite of wear of the parts of differences in the parts due to manufacturing tolerances. The form of the timing mechanism shown in FIGS. 7 through 11 is further advantageous in that it prevents suction of air into the timing mechanism in both timing modes of operation. In both modes, lubricant pressure exists in the passages 271 and 272 and this lubricant pressure prevents exterior air from being sucked into the timing chamber around the upper piston 234. In both modes of operation of this mechanism the two pistons 234 and 236 are separated by the spring 239, but only in the high pressure mode is the timing chamber filled with the lubricant which forms a hydraulic link and serves to advance the timing.

Instead of attaching the timing mechanisms to an injector, they could be mounted elsewhere in the injector drive train. For example, a mechanism could be made part of the support for the cam follower and it could be located between the cam follower and the push tube. It is also of course possible that that timing mechanism could be used with a valve of the engine.

Instead of using spring loaded check valves as illustrated at the inlets to the forms of the invention shown in FIGS. 1 through 6, gravity type check valves could be used. In these forms of the invention, the inlet check valve could be entirely eliminated and replaced by an inlet port located to be closed by the upper piston at the start of the injection stroke. Further with regard to the forms shown in FIGS. 1 through 6, instead of using a timing spring to control the volume of the timing fluid, an orifice could be provided in the timing fluid in the passage so that the volume would be controlled in accordance with the pressure-time principle. Finally, the cam of the injector drive train could be designed with a long rising or positive ramp so that the timing fluid volume would continue to be slowly squeezed or forced out of the timing chamber through the pressure relief valve up until the time that the follower roller again moves down the negative slope or ramp portion of the drive cam.

What is claimed is:

1. A system for controlling the timing of initiation of injection of a fuel injector of an internal combustion engine, the injector including a movable plunger which is alternately movable in an injection stroke and in a retraction stroke and is operable to inject fuel during the injection stroke, the engine further including movable drive means for moving said plunger, said timing control system comprising housing means having an opening therein, first and second members movably mounted in said opening, said housing means and said members forming a timing chamber therebetween, one of said members being connected to said drive means and the other of said members being connected to said plunger, a timing fluid supply hydraulically connected to said chamber for selectively feeding a timing fluid to said chamber, said timing fluid supply including means for controlling the flow of a timing fluid into said chamber, a quantity of said timing fluid present in said chamber forming a hydraulic link between said members, and pressure release means hydraulically connected to said chamber for releasing any timing fluid therein when the timing fluid pressure in said chamber reaches a predetermined pressure level during injection.

2. A system as in claim 1, wherein said housing is adapted to be mounted on a fuel injector of the engine.

3. A system as in claim 1, further including a timing piston movable in said opening between said first and second members, said timing chamber being between said timing piston and one of said first and second members.

4. A system as in claim 3, wherein said timing chamber is formed between said timing piston and said first member.

5. A system as in claim 3, wherein said feeding means comprises a supply passage leading to said opening, and a timing spring mounted between said timing piston and said second member.

6. A system as in claim 3, wherein said pressure responsive means is mounted on said timing piston.

7. A system as in claim 6, wherein said pressure responsive means comprises a preloaded valve mounted on said timing piston, and a passage in communication with said timing chamber.

8. A system as in claim 7, wherein said valve comprises an orifice formed in said timing position, said orifice extending from said timing chamber to the space between said timing piston and said second member, said passage being in flow communication with said space, and a spring loaded valve member in said orifice, said valve member permitting flow from said timing chamber to said space only at fluid pressures above said preload.

9. A system as in claim 1, wherein said pressure responsive means comprises a preloaded valve connected to said timing chamber, and a return passage in communication with said timing chamber.

10. A system as in claim 1, and further including means for supplying said timing fluid to said timing chamber and for adjusting the pressure of said fluid between at least two pressure levels.

11. A system as in claim 1, wherein said hydraulic connection between said timing fluid supply and said chamber comprises a flow passage in said housing means, and a spring preloaded one-way flow valve in said passage, said timing fluid flowing into said timing chamber when the timing fluid pressure exceeds the spring preload.

12. A system as in claim 11, wherein said one-way flow valve is mounted on one of said members and said pressure release means is mounted on the other of said members.

13. A system as in claim 12, wherein said system further includes pressure regulator means for adjusting the timing fluid pressure from said timing fluid supply at one of two pressure levels, one of said levels being above said spring preload and the other of said levels being below said preload.

14. A system as in claim 12, wherein said pressure regulator means comprises two parallel flow branches, one of said branches including an open-closed valve therein and the other of said branches including a low pressure regulator therein.

15. Apparatus for varying the timing of injection of a fuel injector for an internal combustion engine, the injector including a movable plunger which is movable in an injection stroke and in a retraction stroke and is operable to inject fuel during the injection stroke, and the engine further including drive means for moving the plunger, comprising a housing having a bore formed therein, a first piston movable in said bore and connected to be moved by said drive means, a second piston in said bore and connected to move with said plunger, means for metering a volume of a timing fluid into said bore between said first and second pistons, said timing fluid volume forming a variable length hydraulic link between said first and second pistons, and pressure responsive means connected to said bore for releasing at least a portion of said timing fluid volume when the pressure thereon reaches a predetermined level during said injection stroke.

16. Variable timing apparatus for an engine including drive means and a member to be driven by said drive means, comprising a housing having a bore formed therein, a first piston movable in said bore and connected to be moved by said drive means, a second piston movable in said bore and connected to move said member, means for metering a volume of timing fluid into said bore between said first and second pistons to form a variable length hydraulic link, and preloaded pressure responsive means connected to said bore for releasing a portion of said volume at pressures above a predetermined level.

17. Apparatus as in claim 16, and further including a timing piston between said first and second pistons, said pressure responsive means being mounted on said timing piston.

18. A fuel supply system for an internal combustion engine, comprising an injector including a movable plunger which is movable in an injection stroke and in a retraction stroke and is operable to inject fuel during the injection stroke, drive means for moving the plunger, and variable timing means comprising a housing having a bore formed therein, a first piston movable in said bore and connected to be moved by said drive means, a second piston in said bore and connected to move with said plunger, means for metering a volume of a timing fluid into said bore between said first and second pistons, said timing fluid volume forming a variable length hydraulic link between said first and second pistons, and pressure responsive means connected to said bore for releasing at least a portion of said timing fluid volume when the pressure thereon reaches a predetermined level during said injection stroke.

19. A system as in claim 18, wherein said timing means further includes a timing piston between said first and second pistons, said pressure responsive means being mounted on said timing piston.

* * * * *